United States Patent [19]

Jensen

[11] 4,246,300

[45] Jan. 20, 1981

[54] CAN TRANSPORT

[75] Inventor: Eric L. Jensen, Richmond, Va.

[73] Assignee: Reynolds Metals Company, Richmond, Va.

[21] Appl. No.: 15,957

[22] Filed: Feb. 28, 1979

Related U.S. Application Data

[63] Continuation-in-part of Ser. No. 865,446, Dec. 29, 1977, abandoned.

[51] Int. Cl.[3] ..... B05D 7/22; B05B 13/06

[52] U.S. Cl. ..... 427/233; 118/318; 198/344; 198/617

[58] Field of Search ..... 427/233; 118/318; 198/344, 617

[56] References Cited

U.S. PATENT DOCUMENTS

| | | | |
|---|---|---|---|
| 1,141,339 | 6/1915 | Hodgson . | |
| 1,734,290 | 11/1929 | Eberhart . | |
| 2,088,542 | 7/1937 | Westin | 91/45 |
| 2,103,270 | 12/1937 | Murch | 91/45 |
| 2,244,651 | 6/1941 | Goebel et al. | 91/45 |
| 2,390,457 | 12/1945 | Pearson et al. | 91/45 |
| 3,452,709 | 7/1969 | Hartmeister et al. | 118/2 |
| 3,455,728 | 7/1969 | Kiwiet | 117/96 |
| 3,741,149 | 6/1973 | Gerlovich | 118/2 |
| 3,778,292 | 12/1973 | Rood et al. | 117/43 |
| 3,816,165 | 6/1974 | Horvath et al. | 117/96 |
| 3,898,954 | 8/1975 | Galitz | 118/315 |
| 3,952,698 | 4/1976 | Beyer et al. | 118/314 |
| 3,965,854 | 6/1976 | Scheiber | 118/66 |
| 3,977,358 | 8/1976 | Stroobants | 118/50 X |
| 3,989,001 | 11/1976 | Brigham et al. | 118/50 X |

FOREIGN PATENT DOCUMENTS

| | | |
|---|---|---|
| 525373 | 8/1940 | United Kingdom . |
| 1317850 | 5/1973 | United Kingdom . |
| 1369222 | 10/1974 | United Kingdom . |
| 1525359 | 9/1978 | United Kingdom . |

*Primary Examiner*—James R. Hoffman

*Attorney, Agent, or Firm*—Glenn, Lyne, Girard & McDonald

[57] ABSTRACT

Can bodies are held by means, such as a vacuum, magnetic or other means onto rotating, disc-shaped pads which accompany the cans throughout an indexing route. A can centering guide positions each can on the center of one of the pads to insure eventual alignment with spray guns at two spray stations downstream. A spinner-drive belt encircles a turret and forms a substantially continuous rotational drive for spinning the can-bearing pads. When a vacuum means is employed, the vacuum means comprises a vacuum manifold in the rear of the turret and has manifold groove for vacuum communication with the can through the vacuum pad. As the can-bearing vacuum pads pass along the manifold groove, the cans, being securely centered on the vacuum pads, rotate at the same velocity as the belt-drive vacuum pads.

26 Claims, 8 Drawing Figures

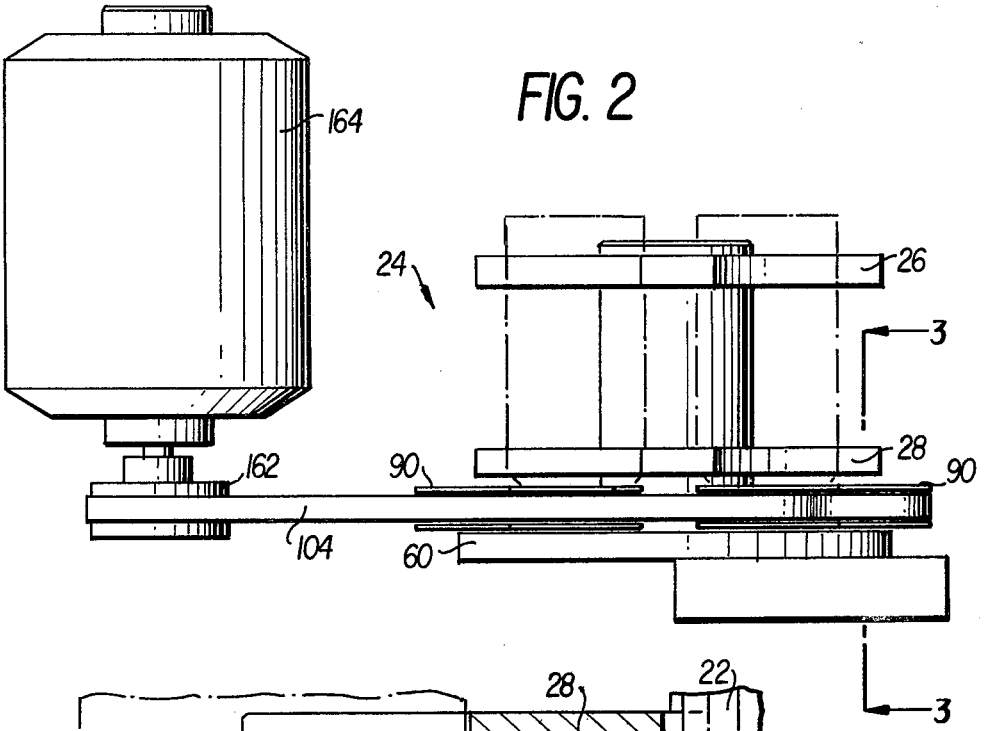
FIG. 2
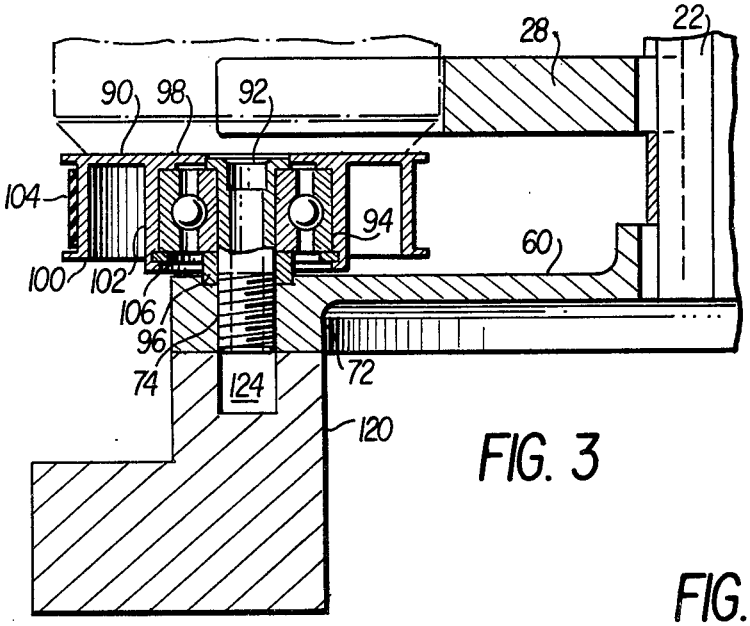
FIG. 3
FIG. 5
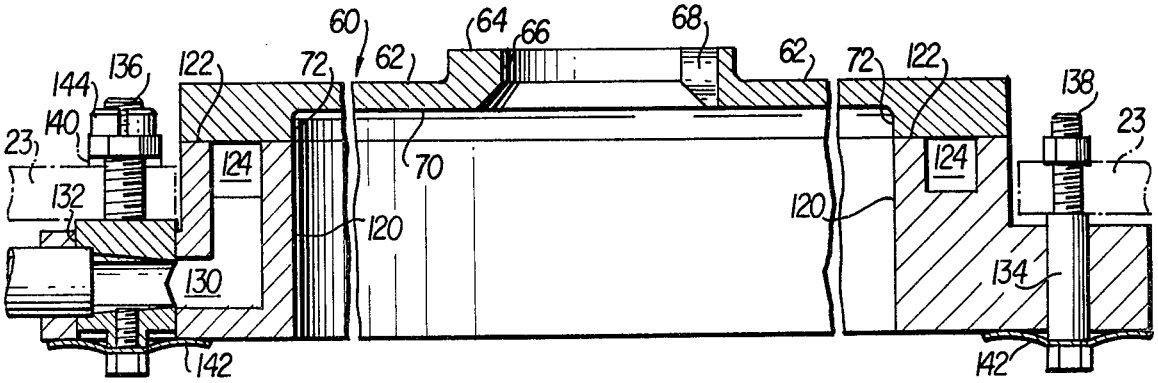

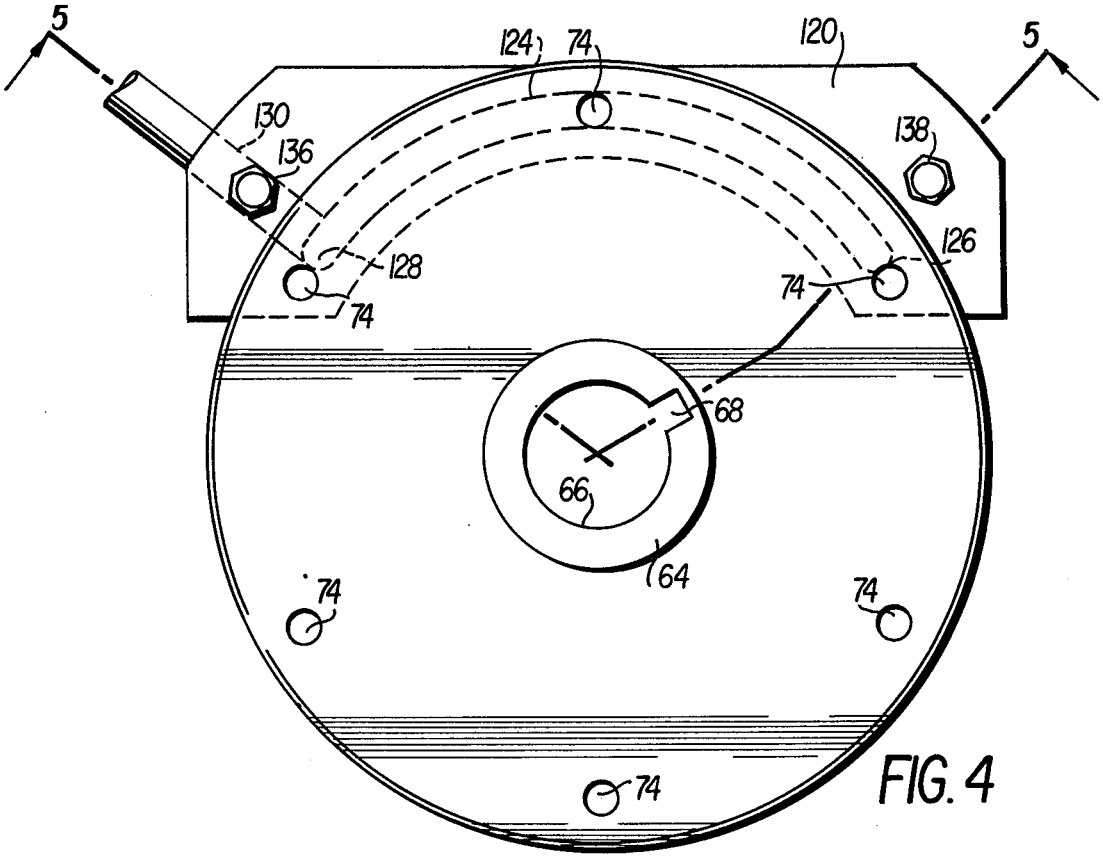
FIG. 4
FIG. 6
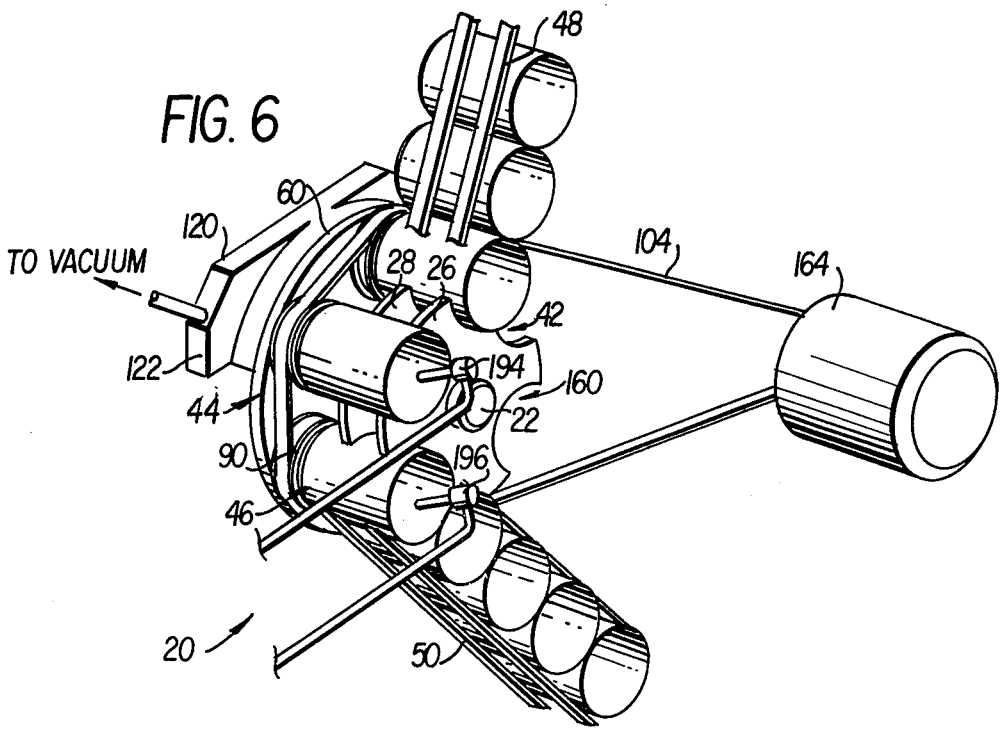

CAN TRANSPORT

CROSS-REFERENCE TO RELATED APPLICATIONS

This is a continuation-in-part of U.S. Application Ser. No. 865,446, filed Dec. 29, 1977, now abandoned.

BACKGROUND OF THE INVENTION

The interiors of can bodies must be coated to protect against corrosion and to insure quality control of the product. For efficient processing of millions of such cans, it is imperative that the interior coating be applied rapidly, uniformly, and economically. To this end, indexing turrets have been employed wherein a coating spray is applied to can interiors as the open-ended cans are indexed past coating-spray guns located at one or more spray stations along the turret indexing route.

A common problem associated with current turret arrangements is the lengthy turret dwell time required for satisfactorily spraying the interior of each can.

A further problem is the misalignment both of the can center with respect to the center of the can moving means and of the can interior with respect to the spray gun. Possible adverse consequences of such misalignment include uneven spray application, spray buildup on some interior surfaces, waste of spray and denting and damaging of the cans.

Inventions of earlier vintage sought to reduce the time spent at spray stations. Accordingly, rather than move nozzles around to spray all portions of a can's interior, cans were rotated to spread the spray around the can interior. Can rotation has generally been imparted by drive belts positioned tangentially to the can and in direct contact with the can exterior. However, direct contact with the drive belts has had a tendency to force the can from the center of its transport means, resulting in the undesirable misalignment discussed above. Further, such direct contact has had a tendency to scratch, dent or otherwise damage the can exterior. Scratches cannot be tolerated, especially if the can has been previously printed with exterior decorations. Moreover, rotation of the can in most earlier devices has been inefficient, since a delay has occurred while the can was being accelerated to a satisfactory rotational velocity at the spray station.

In general, as cans journey through a turret mechanism they are moved by a starwheel structure having either pockets or rollers for the cans; and, when a can is not securely centered on its transport means as it is carried through the turret arrangement, there is the hazard of denting and damaging the cans, which are made as light weight as possible.

Another prior art problem relates to overspray. That is, since manufacturers have had no assurance of consistent, accurate can alignment, they have had to increase the spray dosage to maintain a satisfactory coating on the can interiors. At times, therefore, this excess spray builds up unpredictably and uneconomically in the can interior, and some excess spray must be drawn away through a vent stack and wasted.

The prior art has endeavored to combat the above problems by firmly mounting the can at the spray stations by use of a vacuum means. However, the vacuum mounts have occurred only at the spray station with little or no assurance of accurate can centering with respect to the transport mechanism or the spray gun.

In view of the above problems, an object of this invention is to provide a can spraying apparatus which will economically and uniformly distribute a coating on can interiors.

Another object of this invention is to increase the turret indexing frequency by eliminating the time heretofore wasted by a rotational "warm up" at or proximate the spray station.

A further object of this invention is the reduction of can damage and can dents that have resulted from prior can spraying devices.

Still another object of the invention is to reduce the amount of spray required for coating can interiors; and, even another object of the invention is the reduction of waste by reducing the amount of overspray.

SUMMARY OF THE INVENTION

Cans are held by vacuum, magnetic or other means onto rotating, disc-shaped pads which accompany the cans throughout an indexing route. A can centering guide positions each can on the center of one of the pads to insure eventual alignment with spray guns at two spray stations downstream. In a first embodiment, this can centering guide is an adjustable guide which contacts the can bodies. In a second embodiment, this guide is supplemented by or replaced by a guide forming a portion of the pads. A spinner-drive belt encircles a turret and forms a substantially continuous rotational drive for spinning the can bearing pads. When a vacuum means is employed to hold the cans on the pads, the vacuum means comprises a vacuum manifold in the rear of the turret and has a manifold groove for vacuum communication with the can through the vacuum pad. As the can bearing vacuum pads pass along the manifold groove, the cans, being securely centered on the vacuum pads, rotate at the same velocity as the belt-driven vacuum pads.

BRIEF DESCRIPTION OF THE DRAWINGS

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

FIG. 2 is a plan view of a portion of FIG. 1 taken along the lines 2—2 thereof and having cans added thereto;

FIG. 3 is a partial sectional view of FIG. 2 taken along the lines 3—3 thereof;

FIG. 4 is a front view of a vacuum-pocket plate and a vacuum manifold;

FIG. 5 is a partial sectional view of FIG. 4 taken along the lines 5—5 thereof;

FIG. 6 is a perspective view showing the position of cans within a can interior spray mechanism of the invention;

Referring to FIG. 1, a turret indexing mechanism is generally denoted 20. An indexing shaft 22 in the center of the turret mechanism 20 imparts a counter-clockwise rotational motion as generated by a turret drive means located on a frame assembly not shown in FIG. 1. Since it is not the purpose of the present invention to focus on the turret drive means, such structure will not be further described at this time. It should be noted, however, that a purpose of this invention is to reduce the time which cans spend during spraying and, therefore, it is desirable to move them through the turret mechanism 20 as rapidly as practical.

Figure 1:
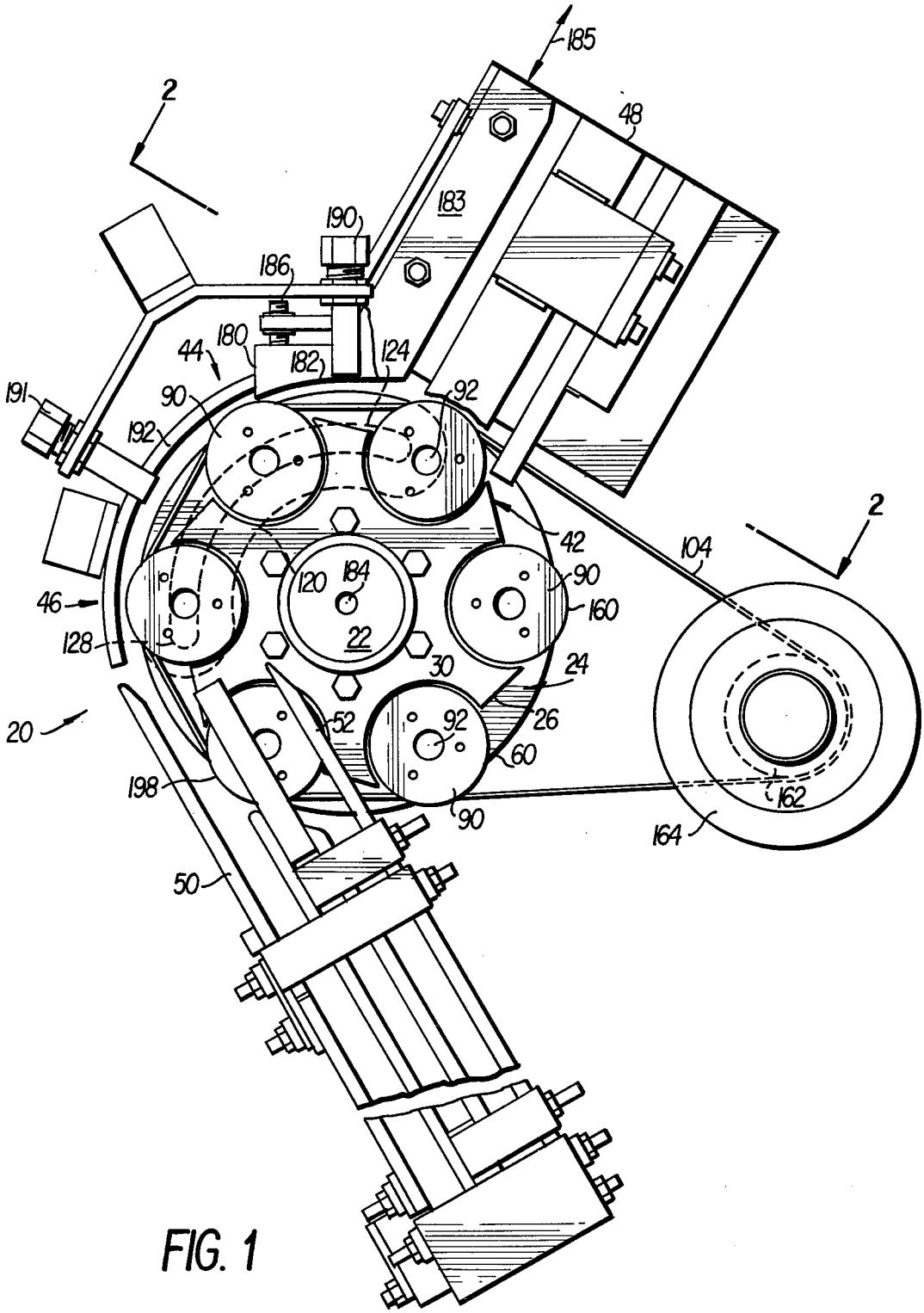
FIG. 1 is a front view of a can interior spray mechanism, according to the invention.

Emanating from the indexing shaft 22 is a starwheel 24 comprising a front starwheel plate 26 and a back starwheel plate 28 (best seen in FIG. 2). Each of the plates 26 and 28 contains a plurality of starwheel pockets 30, with the pockets of plate 26 being positionally aligned with corresponding pockets of plate 28. The starwheel pockets 30 accommodate the cans as they are ushered around the indexing route. Hence, it is inconsequential whether the starwheel is of the pocket design (as shown) or of the conventional roller design.

In the FIGURES, six starwheel pockets 30 are shown with the result that indexing occurs in 60 degree increments. As displayed in FIGS. 1 and 6, during a turret dwell period the starwheel pockets 30 are in significant positions corresponding to processing stations along the indexing route. Specifically, the significant processing stations are denoted as infeed station 42, first spray station 44 and second spray station 46. The salient features of the present invention can be applied to turret arrangements having more or less processing stations by substituting appropriate starwheel plates with the desired number of pockets and by adjusting the indexing and driving means to index in the appropriate increments.

Adjacent infeed station 42 is infeed chute 48 which supplies cans to the turret indexing arrangement 20. The cans may be currently conventional drawn and ironed aluminum or steel can bodies for beverages, open at one end and integrally closed at the other, or may be of other constructions and materials for other products. The cans fall by gravity through infeed chute 48 in single file, pushing the can first in line into infeed station 42 as it becomes vacant. A timed released gate (not shown) at the base of infeed chute 48 prevents jamming and prohibits entry of the first can in the infeed chute until a predetermined number of cans are stacked within the infeed chute.

A discharge chute generally denoted 50 includes a can scoop rail 52 for removing the cans from the indexing mechanism 20.

Behind starwheel 24 and firmly affixed to indexing shaft 22 is a disc-shaped vacuum pocket plate 60 (see FIGS. 2, 3, and 5). Vacuum pocket plate 60 has a diameter slightly greater than that of starwheel plates 26 and 28 so that its rim can be seen from the front of the turret indexing mechanism in FIG. 1. A front surface 62 of vacuum pocket plate 60 has a circular elevated collar portion 64 (see FIG. 5) surrounding a shaft engagement hole 66 which extends through the center of the vacuum pocket plate 60.

Shaft engagement hole 66 is notched at 68 throughout said hole, thereby permitting the vacuum pocket plate 60 to receive indexing shaft 22 and to be locked thereon (see FIG. 4). Accordingly, vacuum pocket plate 60 is indexed at the same velocity as the starwheel 24.

A back surface 70 of vacuum pocket plate 60 has a raised circular rib 72 along the circumference of the plate 60 in FIG. 5 and is concentric with shaft engagement hole 66. Rib 72 on vacuum pocket plate 60 has six holes 74 bored therethrough in positions 60 degrees apart to correspond with the center of the six starwheel pockets 30 (See FIG. 4).

Mounted on vacuum pocket plate 60 between plate 60 and starwheel plate 28 are six steel disc-shaped vacuum pads 90. As seen in FIG. 1, the six vacuum pads 90 are aligned with the six starwheel pockets 30. During most of the turret route each vacuum pad 90 has a can sucked thereon and the pad accompanies the can throughout the indexing route.

Referring now to FIG. 3, the center of each vacuum pad 90 receives a hollow fastener, such as a hexagonal vacuum pad bolt 92, through which a vacuum is communicated to the can riding on the pad. The vacuum pad bolt 92 extends through the vacuum pad 90; through a vacuum pad bearing 94 contained in the vacuum pad 90; through a vacuum pad spacer 96 positioned adjacent bearing 94; and, finally, through one of the six holes 74 bored through rib 72 of vacuum pocket plate 60. In this manner, the vacuum pad 90 is free to spin while mounted on the vacuum pocket plate 60, which is indexed with the starwheel 24, while connected to the vacuum.

The vacuum pad further comprises a can bearing surface 98 connected to two concentric annular ribs 100 and 102. External rib 100 contacts a spinner-drive belt 104 which imparts a rotational force to spin the vacuum pad 90. Internal rib 102 is notched to receive beveled retainer ring 106, thereby forming a circular cavity in the vacuum pad 90 which houses vacuum pad bearing 94.

As seen in FIGS. 4 and 5, immediately behind vacuum pocket plate 60 is a kidney-shaped vacuum manifold 120. Vacuum pocket plate 60, being locked to the rotating indexing shaft 22, skims a front surface 122 of vacuum manifold 120 during indexing. The stationary vacuum manifold 120, which is not coupled with the indexing shaft 22, is mounted within a frame assembly 23 as hereinafter detailed.

FIG. 1 reveals that the vacuum manifold 120 is positioned in the vicinity of infeed station 42; first spray station 44; and second spray station 46. FIG. 4 (as well as FIG. 1) illustrates a semicircular channel or vacuum manifold groove 124 cut in the vacuum manifold 120 from point 126 to point 128. As shown in FIG. 1, point 126 resides slightly past the center of infeed station 42 as the turret indexes. Similarly, point 128 resides slightly past the center of second spray station 46. In the illustrated embodiment, the vacuum manifold groove 124 is 0.5 inch (1.27 centimeter) wide and extends 0.5 inch (1.27 centimeter) deep into the vacuum manifold 120.

A vacuum pump interface hole 130 is radially bored into the vacuum manifold 120 to connect with the vacuum manifold groove 124, thereby allowing communication with a vacuum source (not shown) for maintaining the vacuum at 500 mm. mercury, in a preferred embodiment. Also bored through the vacuum manifold are holes 132 and 134 (FIG. 5) for accommodating vacuum manifold stud bolt 136 and stud bolt 138, respectively, which anchor the vacuum manifold 120 in frame member 23, as seen in FIG. 4. Since hole 132 intersects the vacuum pump interface hole 130, vacuum manifold stud bolt 136 is drilled perpendicularly to the stud shaft to allow air passage through the bolt.

FIG. 5 exhibits the attachment of the vacuum manifold 120 within the frame member 23 by means of the vacuum manifold stud bolt 136, washer 140, retaining spring 142 and screw cap 144. Although stud 138 is not drilled to facilitate air passage, the manner of fixation is comparable.

Encircling the turret indexing arrangement 20 is spinner-drive belt 104 which loops around all vacuum pads except that particular vacuum pad which happens, at any given time, to be located at idle turret position 160 in FIG. 1. Spinner-drive belt 104 also contacts drive pulley 162 of spinner-drive motor 164. In the illustrated embodiment spinner-drive belt 104 is a flat belt approximately 0.5 inch (1.27 centimeter) wide and flexible enough to absorb the slight difference in belt length as indexing mechanism 20 indexes through the different positions. Spinner-driver belt 104 forms a continuous rotational drive for the vacuum pads 90 and the cans mounted thereon. The rotational speed of vacuum pads 90 can easily be changed by altering either the speed of the spinner-drive motor 164 or the size of the drive pulley 162. The spinner-drive belt can be driven in either direction, but it is preferred that its direction be opposite that of the starwheel.

The spinner-drive belt 104 can be driven at a relatively high velocity; and, in this manner, the vacuum pads 90 and the cans mounted thereon are rotated at high velocity at the coating stations 44 and 46 so that more "wraps" of spary (layers of coating) are delivered to the interior of the cans at the spray stations 44 and 46. This increased number of "wraps" provides a more uniform interior coating than has been obtained on cans using conventional spray structures. That is, as will be described more fully later, the indexing mechanism 20 permits each can to dwell at the spray stations for a given period of time; and the faster the cans are spun during that time, the more time a given point of the can's interior will pass a point on the spray pattern.

Additionally, the cans are rotated at this high speed without being driven by a mechanism in contact with their side walls. This eliminates dents and other damage to the can bodies and/or the decorative printing which is often placed on the can bodies prior to their interior spray coating. This also eliminates the tendency for can driving systems to force the cans out of alignment with the spray pattern and thus cause overcoating and undercoating of various regions of the cans.

Attached to infeed chute 48 and positioned between infeed station 42 and first spray station 44 in this embodiment is a can centering guide 180. A can contacting surface 182 thereof forms a radial guide concentric with the center 184 of the indexing shaft 22. Adjustment screw 186 is used to selectively vary the radial distance from the center 184 of the indexing shaft 22. In this respect, the can centering guide 180 can be pre-set by a dial indicator for reasons to be discussed more fully shortly. Similarly, a leg 183 to which centering guide 180 is attached is movable up and down in the direction of arrow 185 to adjust the overall distance of contacting surface 182 from center 184 and the rotating cans.

Other structural features of the can spray mechanism include can sensors 190 and 191 for detecting the location of cans traveling through the indexing turret and initiating a timing sequence for spraying at first spray station 44 and second spray station 46. Each spray station is paired with a can sensor 190. When passing by spray stations 44 and 46, the cans are guided, but not contacted, by turret guard rail 192.

FIG. 6 shows spray guns 194 and 196 positioned at first spray station 44 and second spray station 46 respectively. Spray guns 194 and 196 apply a thin, uniform coating to the interior of the open-ended cans as they are spun on vacuum pads 90 in the manner described above.

Focusing now in the operation of the can interior spray mechanism, as the cans queue up in the infeed chute 48, gravity draws the first can into the vacant starwheel pocket 30 at infeed station 42. FIG. 6 illustrates how the cans, in single file, push the lowermost can into infeed station 42 as that station becomes vacant during a turret dwell.

As a can falls into starwheel pocket 30 at infeed station 42, the can encounters front and back starwheel plates 26 and 28, as well as the vacuum pad 90. While in infeed station 42 the can is not rotating. Vacuum pad 90 is rotating, however, since it is driven by spinner-drive belt 104. The rotation of the vacuum pad 90 is not imparted to the can at this point, because the can is not in communication with the vacuum while in infeed station 42.

As the turret begins to index in the counterclockwise direction the first of a sequence of significant steps occurs. That is, when the turret has indexed just a few degrees past infeed station 42, the vacuum pad 90 communicates with vacuum manifold 120 to promptly suck the can onto vacuum pad 90 at point 126 so that the can begins to spin with the same rotational velocity as the belt-driven vacuum pad 90. That is, vacuum from manifold 120 is delivered to pad 90 through hollow fastener 92 and hole 74 of vacuum pocket plate 60. Hence, while the vacuum pad 90, vacuum pocket plate 60 and hole 74 ride over the vacuum manifold groove 124 from point 126 to point 128, the can is in continuous communication with the vacuum manifold 120; and, the can rotates continuously as it is moved between points 126 and 128.

The second significant step upon leaving infeed chute 42 is the centering of the can on the vacuum pad 90 by means of can centering guide 180. The can is centered on the vacuum pad 90 to reduce the quantity of spray required and the possibility of can damage as aforementioned. As the can encounters the can centering guide 180, the outer diameter of the can rolls against the can contacting surface 182 which is concentric with the center of the indexing shaft 184 and radially spaced therefrom so that clearance will be permitted only when the can is at the center of the vacuum pad 90. As vacuum pad 90 spins, can contacting surface 182 keeps nudging the can to the center of vacuum pad 90. To move past the can centering guide 180, the can diameter must be centered on the center of the vacuum pad 90 so that the loci of the outside surface of the can is concentric with the can contacting surface 182.

The third significant event occurring after departure from the infeed chute 42 is the detection of the can by the can sensor 190 located between infeed chute 42 and first spray position 44. Upon detecting the can by photoelectric or other means, can sensor 190 triggers a timing sequence for the spray gun 194 in FIG. 6. Likewise, after the can has received a partial coat of spray at first spray station 44, can sensor 191, located between first station 44 and second spray station 46, is activated by the presence of the can and initiates a timing sequence for spray gun 196 at second spray station 46.

Preferably, the coating is partially applied at each station. That is, at station 44 spray gun 194 is aimed at the bottom of the can, and, at spray station 46 spray gun 196 concentrates on the cylindrical sides. Although some overlapping results, it has been found that this manner of spraying requires less spray overall.

As noted above, at each spray station the vacuum pad 90 and can mounted thereon are rotating since they are driven by spinner-drive belt 104; and, in a preferred embodiment, the rotational speeds of the cans range between 2,000 and 2,500 rpm. In this respect, the can speed can be adjusted by varying the size of drive pulley 162 or the speed of spinner-drive motor 164.

In any event, the faster the rotational velocity, the greater the number of spray wraps per unit of time in each can; and, the greater the number of wraps, the more even the coating application. Moreover, it should be appreciated that cans have customarily been "oversprayed" simply to provide a minimum coating thickness at all portions of their interior. Hence, by providing a more uniform coating, less spray is required; less time is required at the spray stations; and, the unit can move faster.

Additionally, since the can is centered with respect to the vacuum pad 90 and the pre-set spray guns 194 and 196, little or no spray is lost or wasted due to misalignment of the spray gun and can.

In the above regard, it has been noted that prior systems have used driving belts to contact the can peripheries to rotate the cans during spraying. Those systems, however, have a tendency to push the cans against the starwheel pocket or the like and displace the cans from the center of the spray pattern. The structure of the instant invention, however, permits the cans to be continuously spun without being moved out of the desired central alignment with the spray pattern. Hence, not only is a more uniform coating obtained, but there is far less overspray to go out a vent and pollute the atmosphere.

After the final coat of spray is applied at second spray station 46, the turret again indexes. When the turret has indexed just a few degrees past the second spray station 46, the vacuum pad 90 and the can mounted thereon traverse point 128 on the vacuum manifold groove 124. Since point 128 is the end of the vacuum manifold groove 124, vacuum pad 90 and the can mounted thereon are severed from the vacuum. At this point, the vacuum pad 90 continues to rotate since it is driven by spinner-drive belt 104. The can itself is no longer secured to vacuum pad 90, but its rotational momentum causes it to continue to spin. At starwheel pocket 198 the can is stripped from vacuum pad 90 by can scoop rail 52. The can then falls by gravity through the discharge chute 50.

Figure 7:
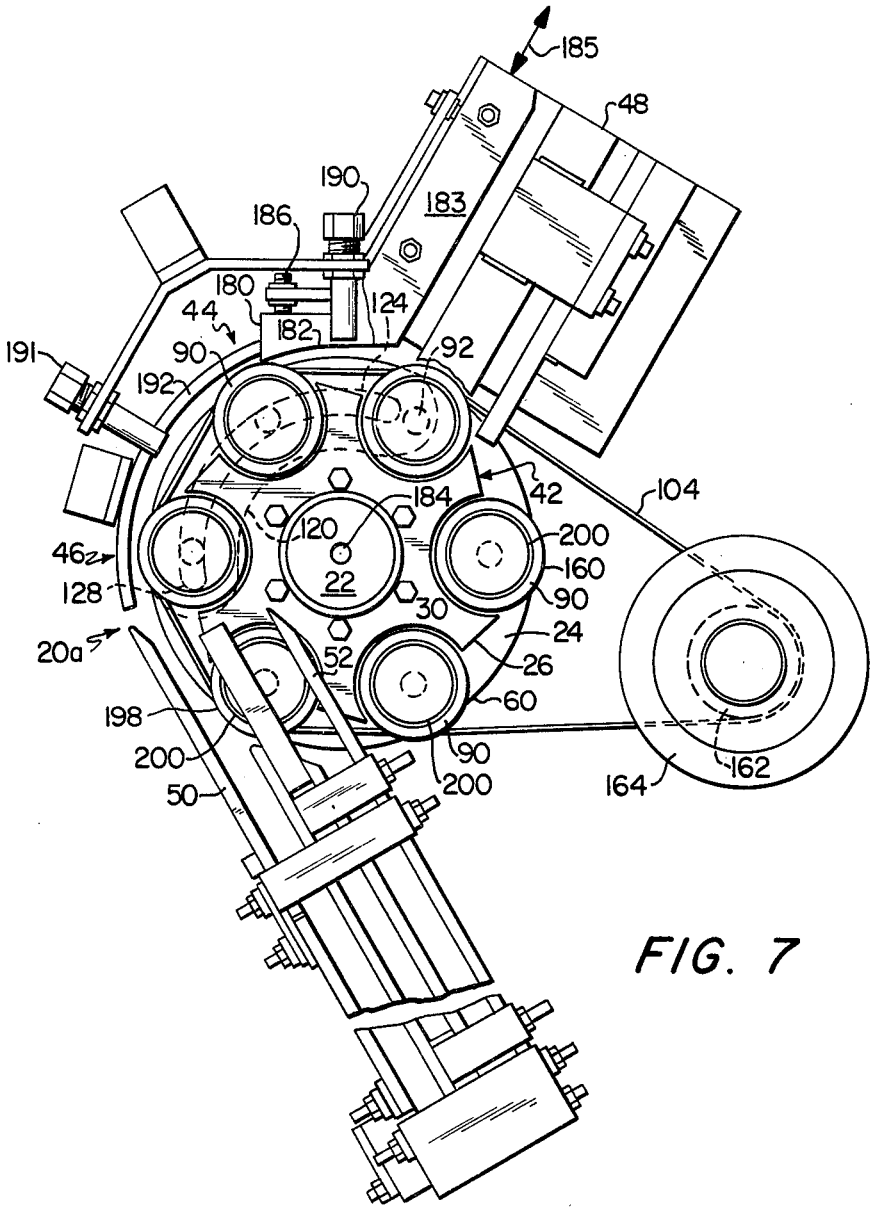
FIG. 7 is a front view of a modified can interior spray mechanism, according to the invention.
Figure 8:
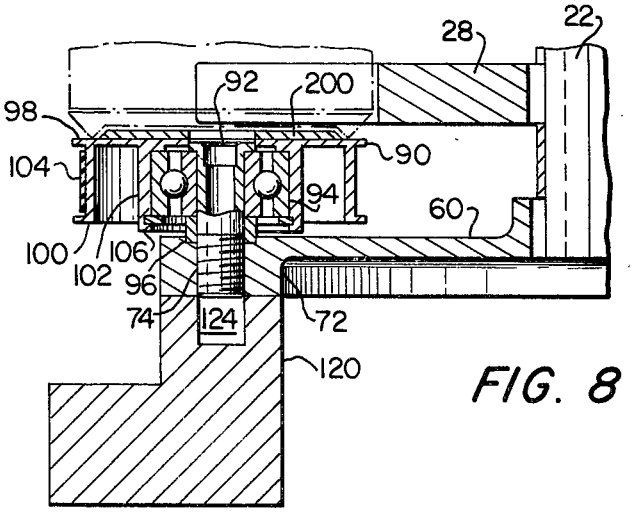
FIG. 8 is a partial sectional view, similar to FIG. 3, of the modified can interior mechanism of FIG. 7.

A modified can transport mechanism is illustrated in FIGS. 7 and 8. With one exception, to be noted below, this embodiment is identical in all respects to the embodiment of FIGS. 1–6 and operates in the same manner. Thus, while the corresponding reference numerals have been repeated in FIGS. 7 and 8, their operation need not be repeated.

The modification of this embodiment concerns the vacuum pads 90. In this embodiment, the generally planer pads 90 include a guide boss 200. This boss 200 is generally disc-like, and is sized and shaped on its peripheral surfaces to permit a can body to fit thereover. The boss 200 is open at its center to the vacuum. The boss 200 may be attracted to or formed as an integral portion of vacuum pads 90.

When a can body is drawn by the vacuum to the vacuum pad 90, it is drawn from the starwheel 24. While the starwheel 124 does not alone always center the can body exactly on the pad 90, as previously mentioned, the deviation from center is, while not acceptable for spraying purposes, as mentioned above, not excessive. As the can body is drawn to vacuum pad 90, if it is not exactly centered when drawn to the vacuum pad 90, it will rock on the guide boss 200. That is, the can bottom will align itself on the guide boss 200, due to the vacuum and the spinning of the can body, so that the can bottom fits over the guide boss 200 and the can body is centered on the vacuum pad 90.

The guide boss 200 may be used in addition to the can centering guide 180. However, the guide boss 200 may replace the guide 180. When this is accomplished, there is no contact of the peripheral surfaces of the can bodies while they are rotating on the vacuum pads 90. This further reduces any change for damage to the can body or the decorative printing thereon.

While the invention has been particularly shown and described with reference to preferred embodiments thereof, it will be understood by those skilled in the art that various alterations in form and detail may be made therein without departing from the spirit and scope of the invention. For example, more rotating vacuum pads can be used; more spray stations can be employed; and, where steel cans are used, the bottom engaging means can be electro-magnetic rather than the illustrated vacuum-type.

While present preferred embodiments of the invention have been illustrated and described, it may be otherwise embodied and practiced within the scope of the following claims.

I claim:

1. An apparatus for moving can bodies past a series of work stations comprising a generally disc-shaped bottom engaging means having a bottom engaging surface upon which said can bodies may be slidably positioned for engaging the bottoms of said can bodies at the first of said work stations, guide means for slidably centering the bottoms of said can bodies on said bottom engaging surface of said bottom engaging means, means for spinning said bottom engaging means and thereby spinning said can bodies without said spinning means contacting the peripheries of said can bodies and means for indexing said bottom engaging means and thereby said can bodies past said series of work stations.

2. The apparatus of claim 1 wherein said bottom engaging means includes vacuum means for engaging the bottoms of said can bodies on said bottom engaging means.

3. The apparatus of claim 2 wherein said bottom engaging means includes a generally disc-shaped guide boss over which the bottoms of said can bodies are fitted.

4. The apparatus of claim 1 wherein said bottom engaging means includes a generally disc-shaped guide boss over which the bottoms of said can bodies are fitted.

5. The apparatus of claim 4 wherein said bottom engaging means are mounted on an indexable turret for indexing said can bodies past said series of work stations and wherein said guide means includes means contacting the peripheries of said can bodies for slidably guiding said can bodies on said bottom engaging surface of said bottom engaging means so that the peripheries of said can bodies move along an arc that is concentric with the center of rotation of said turret.

6. The apparatus of claim 5 including means for adjusting said means contacting the peripheries of said can bodies to adjust the path of travel of said can bodies during guiding thereof with respect to the center of rotation of said turret.

7. The apparatus of claim 1 wherein said bottom engaging means includes a plurality of generally disc-shaped pads mounted on an indexable turret, each of said pads having a bottom engaging surface upon which said can bodies may be slidably positioned, and wherein said means for spinning includes belt-drive means mounted around said turret and being operative to spin said pads.

8. The apparatus of claim 7 wherein said pads each include a generally disc-shaped guide boss on said bottom engaging surfaces over which the bottoms of said can bodies are fitted.

9. The apparatus of claim 8 wherein said bottom engaging means further includes vacuum means for engaging the bottoms of said can bodies on said bottom engaging means.

10. The apparatus of claim 7 wherein said bottom engaging means further includes vacuum means for engaging the bottoms of said can bodies on said bottom engaging means.

11. The apparatus of claim 1 wherein said bottom engaging means are mounted on an indexable turret for indexing said can bodies past said series of work stations and wherein said guide means includes means contacting the peripheries of said can bodies for slidably guiding said can bodies on said bottom engaging surface of said bottom engaging means so that the peripheries of said can bodies move along an arc that is concentric with the center of rotation of said turret.

12. The apparatus of claim 11 including means for adjusting said means contacting the peripheries of said can bodies to adjust the path of travel of said can bodies during guiding thereof with respect to the center of rotation of said turret.

13. The apparatus of claim 1 including spraying means located at a plurality of said work stations for spraying the interiors of said can bodies.

14. The apparatus of claim 13 wherein said bottom engaging means includes vacuum means for engaging the bottoms of said can bodies on said bottom engaging means.

15. The apparatus of claim 13 wherein said bottom engaging means includes a plurality of generally disc-shaped pads mounted on an indexable turret, each of said pads having a bottom engaging surface upon which said can bodies may be slidably positioned, and said means for spinning includes a belt-drive means mounted around said turret and being operative to spin said pads.

16. The apparatus of claim 13 wherein said bottom engaging means includes a generally disc-shaped guide boss over which the bottoms of said can bodies are fitted.

17. The apparatus of claim 16 wherein said bottom engaging means are mounted on an indexable turret for indexing said can bodies past said series of work stations and wherein said guide means includes means contacting the peripheries of said can bodies for slidably guiding said can bodies on said bottom engaging surface of said bottom engaging means so that the peripheries of said can bodies move along an arc that is concentric with the center of rotation of said turret.

18. The apparatus of claim 17 including means for adjusting said means contacting the peripheries of said can bodies to adjust the path of travel of said can bodies during guiding thereof with respect to the center of rotation of said turret.

19. The apparatus of claim 13 wherein said bottom engaging means are mounted on an indexable turret for indexing said can bodies past said series of work stations and wherein said guide means includes means contacting the peripheries of said can bodies for slidably guiding said can bodies on said bottom engaging surface of said bottom engaging means so that the peripheries of said can bodies move along an arc that is concentric with the center of rotation of said turrent.

20. The apparatus of claim 19 including means for adjusting said means contacting the peripheries of said can bodies to adjust the path of travel of said can bodies during guiding thereof with respect to the center of rotation of said turret.

21. A method of moving can bodies past a series of work stations including the steps of engaging the bottoms of said can bodies by a generally disc-shaped bottom engaging means having a bottom engaging surface upon which said can bodies may be slidably positioned at a first of said work stations, slidably centering said can bodies on said bottom engaging surface of said bottom engaging means, indexing said can bodies past said series of work stations and spinning said can bodies without said spinning means contacting the peripheries of said can bodies as said can bodies are indexed past said series of work stations.

22. The method of claim 21 wherein said engaging includes holding the bottoms of said can bodies onto said bottom engaging means by means of a vacuum.

23. The method of claim 21 wherein said centering includes fitting the bottoms of said can bodies over a guide boss on said bottom engaging surface of said bottom engaging means.

24. The method of claim 21 wherein said centering includes contacting the peripheries of said can bodies to thereby slidably guide said can bodies so that the peripheries of said can bodies move in an arc that is concentric with the center of rotation of said can bodies as said can bodies are indexed past said series of work stations.

25. The method of claim 21 wherein said centering further includes contacting the peripheries of said can bodies to thereby slidably guide said can bodies so that the peripheries of said can bodies move in an arc that is concentric with the center of rotation of said can bodies as said can bodies are indexed past said series of work stations.

26. The method of claim 21 including the step of spraying the interiors of said can bodies at at least one of said series of work stations.

* * * * *